United States Patent [19]

Phillips

[11] Patent Number: 5,021,040

[45] Date of Patent: Jun. 4, 1991

[54] PAPERBOARD CONTAINER HAVING LEAK PREVENTATIVE RAISED SEALING SCORES

[76] Inventor: Robert D. Phillips, 153 Seaward Way, Avon Lake, Ohio 44012

[21] Appl. No.: 54,308

[22] Filed: May 21, 1987

[51] Int. Cl.[5] ..... B65D 5/42; B65D 5/08

[52] U.S. Cl. ..... 493/133; 229/3.1; 229/137; 229/198.2; 493/183

[58] Field of Search ..... 229/17 R, 176, 137, 229/138, 48 T, 48 SA, 48 SC, 3.1, 184; 493/133, 156, 183

[56] References Cited

U.S. PATENT DOCUMENTS 3,421,678 1/1969 Thompson et al. ..... 229/3.1
3,604,613 9/1971 Haas ..... 229/3.1
3,913,825 10/1975 Brownlee et al. ..... 229/3.1
4,586,643 5/1986 Halabisky et al. ..... 229/3.1

FOREIGN PATENT DOCUMENTS 1068146 5/1967 United Kingdom ..... 229/48 T

*Primary Examiner*—Gary E. Elkins
*Attorney, Agent, or Firm*—Evelyn M. Sommer

[57] ABSTRACT

Improved liquid containers are provided characterized by at least one raised sealing score formed in the blank such that when assembled, the raised portion of the sealing score substantially abuts the free edge of a side seam and/or bottom panel, respectively, thereby eliminating liquid seepage from said container.

2 Claims, 2 Drawing Sheets

ROTATE 180°

PAPERBOARD CONTAINER HAVING LEAK PREVENTATIVE RAISED SEALING SCORES

TECHNICAL FIELD

This invention relates to improved containers for liquids and more particularly, to containers formed with raised sealing scores to enhance the effectiveness of the bottom seal and to prevent seepage of liquid from the container.

BACKGROUND OF THE INVENTION

Blanks for forming moisture resistant containers are well known in the art. Score lines divide the blank into a plurality of panels. The container is formed by folding the blank along the score lines and appropriately sealing the edges. The blank usually comprises paperboard or fiberboard which is treated with a variety of waxes or polymeric substances to maintain the integrity of the carton. Toward this end, metal foils have also been used in laminate blank structures.

However, leakage through the material and seepage past an edge still remain as significant problems. A standard method of overcoming the leakage is to employ thicker sealant layers or polymeric sealants on the paperboard in the areas of the score line. U.S. Pat. No. 4,586,643 to Halabisky et al discloses use of polyethylene to minimize leakage when used in the horizontal score lines of the carton.

Other prior art sealing techniques include the hot melt application method of McNair, Jr. et al, in U.S. Pat. No. 3,365,111. The Brownlee et al U.S. Pat. Nos. 3,913,825 and 3,913,826 disclose use of a continuous thermoplastic band along the bottom edge of the blank which, when heated, melts and seals the edge of the bottom closure together when the container is formed.

Specific attempts to overcome the liquid seepage problem are seen in U.S. Pat. No. 3,305,383 to Gordy which teaches the method of impregnating a flat carton blank in certain confined areas with normally solid hydrophobic materials such as various waxes. The substrate is then heated to facilitate penetration of the hydrophobic material into the blank. U.S. Pat. No. 3,107,586 to Ragan teaches a method of preventing liquid seepage from paperboard containers which utilizes a hot melt or similar adhesive coated on certain of the overlapping portions of a carton while simultaneously applying a release agent material to the surface of the carton engaged by the overlapping portions.

With all of the attempts in the prior art to prevent such seepage, some leakage of material at the edge of overlapping areas still remains. Most of the prior art efforts to prevent liquid seepage have entailed using an adhesive along the edges to be sealed. Although such methods have decreased the amount of liquid seepage from the container, it is virtually impossible to coat the panel edges uniformly, and the results heretofore obtained have been less than satisfactory. Moreover, such processes mandate an additional step in carton production, and thus increase the overall cost of production.

It would be advantageous to have a means of mechanically preventing seepage of liquid from along the edges of sealed panels which would be fully compatible with existing production methods and which would not involve an additional production step.

SUMMARY OF THE INVENTION

Accordingly, it is an object of the present invention to provide a foldable paperboard liquid container having a seal that prevents seepage of liquid from along an edge of a container panel. Another object of the present invention is to provide a method for sealing a panel of a container from leakage which is fully compatible with existing production methods and which avoids additional production steps.

These as well as other objects and advantages are accomplished by the present invention which provides improvements in a blank for a liquid container which comprises an upper sealing section; a foldable upper section integral therewith adapted to form a gabled closure for the container; a plurality of foldable wall panels integral with the upper closure section forming the container walls; a side seam panel integral with one of said foldable wall panels for sealing the container walls; and a foldable lower closure section integral with the side wall panels formed to comprise the container bottom. The lower closure section includes a first foldable bottom panel having longitudinal and transverse free edges and a first raised sealing score formed therein parallel to said transverse free edge. A second foldable bottom panel having a longitudinal free edge can also have a second raised sealing score formed therein parallel to said free edge. The lower side panels are configured such that when configured as a container, the lower free edge of the side seam panel substantially abuts the raised portion of the first sealing score and the longitudinal free edge of the first foldable bottom panel substantially abuts the raised portion of the second sealing score.

In another aspect of the present invention, a method of sealing a liquid container formed from a blank having a plurality of foldable panels is provided comprising forming a raised sealing score line in a first panel and assembling the blank into a container so the free edge of a second panel substantially abuts the raised portion of the sealing score line in said first panel.

DESCRIPTION OF THE PREFERRED EMBODIMENT

Figure 1:
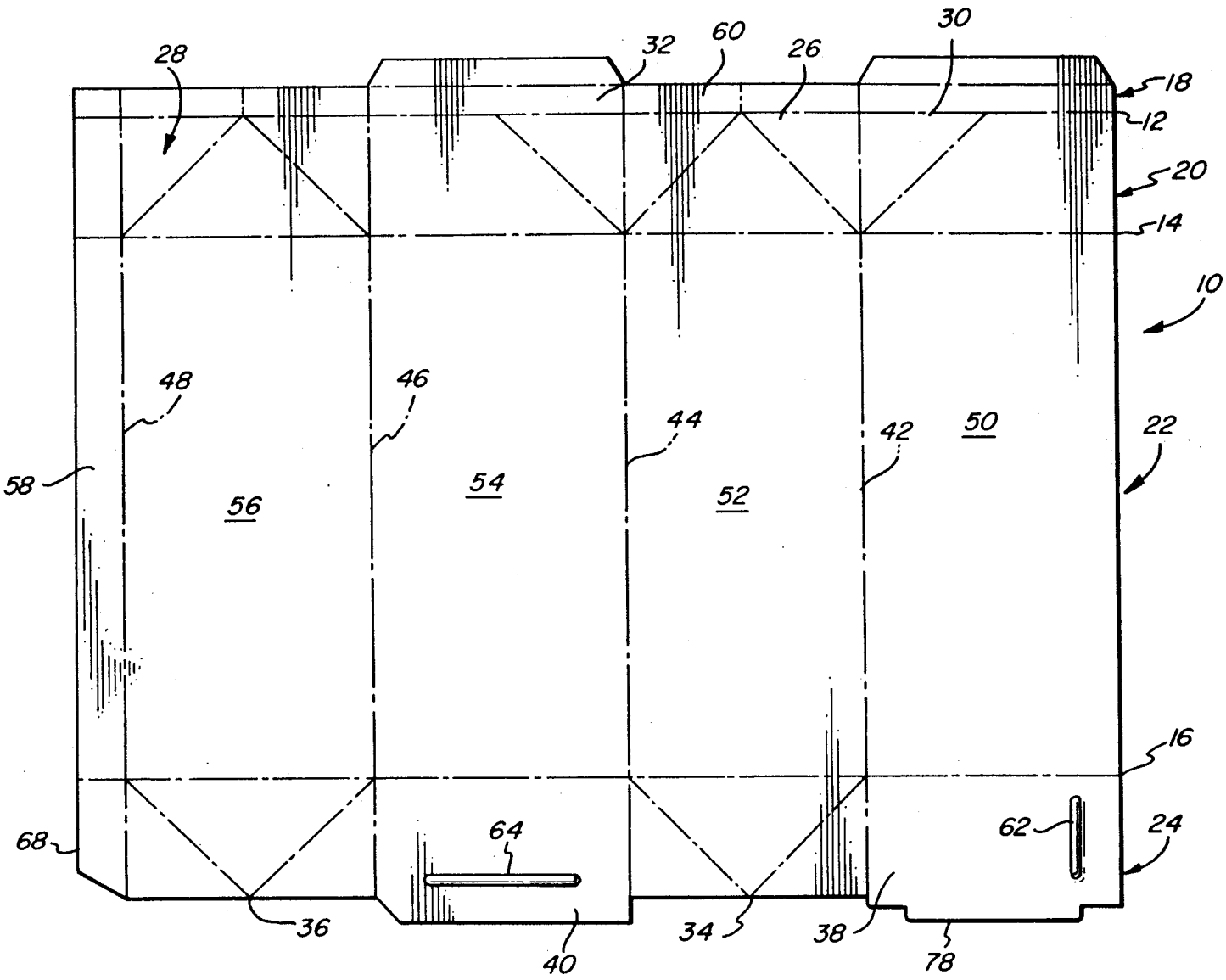
FIG. 1 is a planar view of a container blank having a plurality of sealing scores provided by the present invention.

Referring now to FIG. 1, there is illustrated, in plan, a container blank 10. As is conventional, reinforced or otherwise treated paperboard is cut and scored to form a plurality of foldable panels, the blank is subsequently configured to form a liquid container, such as a milk or juice carton. Typically, these type liquid containers are flat bottomed and have a gabled upper closure section. In FIG. 1, the inside of the blank is shown.

In the preferred embodiment, the grain of the board which comprises the blank usually runs transversely across the blank. Blanks are made from approved paperboards that are uniformly coated with proper weights of conventional wax or polymeric coatings. In finished form, the blank has a matte finish on the inside and a gloss finish on the outside. The blank has a standard container geometry and is scored in a conventional fashion from a 0.28 scoring rule in the preferred embodiment, although other scoring rules may be substituted.

The blank 10 is divided by longitudinal score lines 12, 14, and 16 into an upper sealing section 18, upper closure section 20, side panel section 22, and lower closure section 24. The upper closure section includes upper gabled sections 26 and 28 as well as foldable upper side panels 30 and 32. Similarly, lower closure section 24, which is adapted to fold flat, includes lower triangulated or gusset-forming panels 34 and 36 as well as foldable bottom panels 38 and 40.

The container blank is also divided by transverse score lines 42, 46, and 48 into a plurality of side wall panels, side panel 50, second side panel 52, third side panel 54, fourth side panel 56 and side seam panel 58.

Side seam panel 58 is also conventional, and may typically contain a layer of foil or a coating of a liquid impervious material. All scores on the side seam panel in the preferred embodiment have a gap of approximately 0.1 inches of width at the center of the seam.

To form the container from blank 10, the blank is folded in a conventional manner and all free edges and seams including side seam panel 58 are securely bonded using a conventional adhesive or coating responsive to hot sealing. Pouring lip area 60 can be coated with an adhesive material, typically a cellophane/polyethylene laminate or a printable flexographing varnish.

The container blank of FIG. 1 is characterized by first and second raised sealing scores 62 and 64, formed in foldable bottom panels 38 and 40, respectively. As described hereinafter, when the container is assembled, the presence of the raised score lines abutting one or more free edges of the side seam panel and/or a bottom panel eliminates leakage due to seepage of liquid past the container blank edges.

Figure 2:
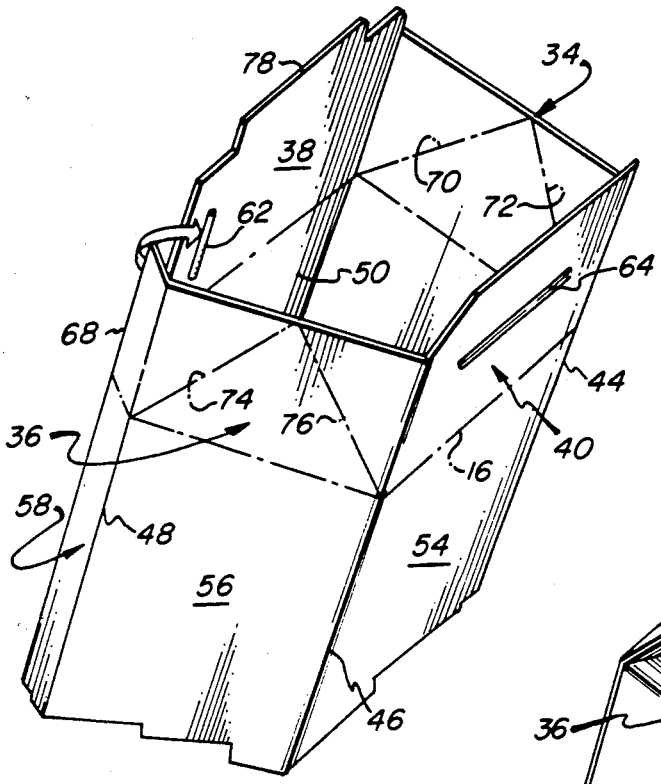
FIG. 2 is a perspective illustration of the bottom of the container blank of FIG. 1 when folded to form side panels.

FIG. 2 is a perspective illustration of the bottom of the container as the container is being formed from the blank of FIG. 1. As is conventional, the blank 10 is to be folded along transverse score lines 42, 44, 46 and 48 such that side seam panel 58 lies inside side wall panel 50 to form a rectangular structure. To form the side seal for the container, the seam is skived, hemmed and sealed. Side seam panel 58 is securely bonded to side wall panel 50 using a conventional adhesive or coating responsive to heat sealing. The lower portion 68 of the free edge of side seam panel 58 substantially abuts first raised sealing score 62 when the side seal is formed. Lower gusset-forming panel 34 includes diagonal score line 70 and 72 while lower gusset-forming panel 36 includes diagonal score lines 74 and 76. The addition of the aforenoted score lines is to enhance the bottom seal on all containers whether skived or non-skived. When used on a skived carton, the score is moved to align with the narrower side seam.

Figure 3:
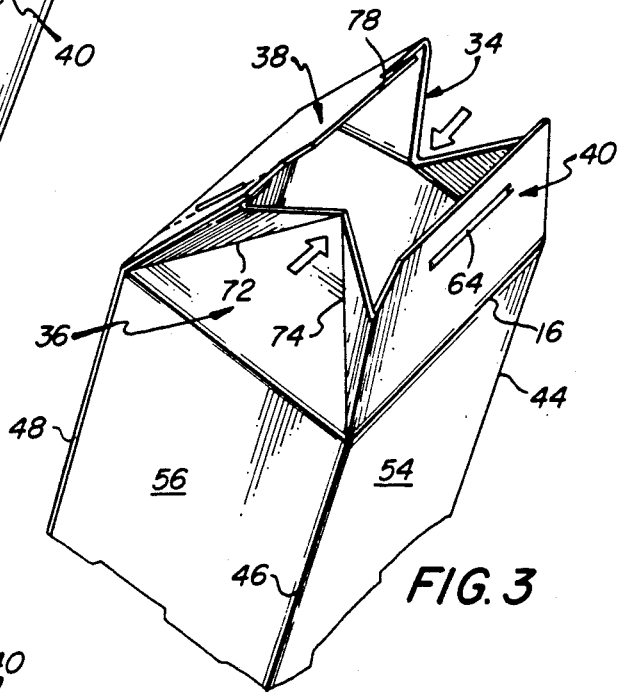
FIG. 3 is a perspective illustration of the container blank of FIG. 2 with a partially folded bottom closure section.

FIG. 3 is a perspective illustration of the container blank of FIG. 1 as the lower closure section is inwardly folded along score line 16 to form the container bottom. The lower gusset-forming panels 34 and 36 are folded as shown in FIG. 3 to allow foldable bottom panels 38 and 40 to approach each other such that the leading edge 78 of foldable bottom panel 38 will be inside of foldable bottom panel 40.

Figure 4:
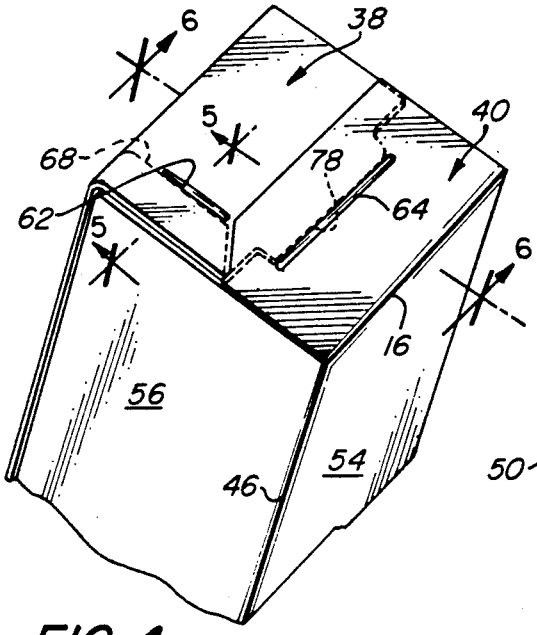
FIG. 4 is a perspective illustration of the container of FIG. 3 with a completely formed container bottom.

FIG. 4 is a perspective illustration of the bottom portion of the container blank of FIG. 1 as it is finally configured illustrating the relationship between the first and second sealing scores 62 and 64 to the edge of the lower portion 68 of side seam panel 58 and the leading edge 78 of lower foldable panel 38, respectively. Both raised sealing scores are configured on the respective bottom panels 38 and 40 so that, upon closure, the edge of lower portion 68 of side seam panel 58 and the leading edge 78 of bottom panel 38 substantially abut the first and second raised sealing scores, respectively.

Figure 5:
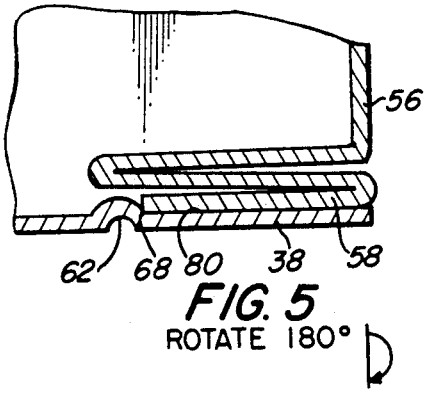
FIG. 5 is a sectional illustration of the container bottom of FIG. 4 rotated to show the relationship of the first raised sealing score of the edge of the side seam panel.
Figure 6:
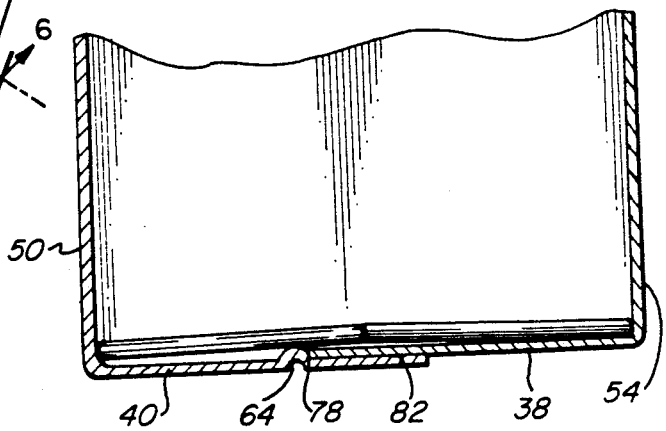
FIG. 6 is a sectional illustration of the container bottom of FIG. 4 rotated to show the relationship of the second raised sealing score to the longitudinal free edge of the bottom panel.

The beneficial effects of the sealing scoring lines can be seen by reference to FIGS. 5 and 6. FIG. 5 is an illustration, in section, of a portion of the container of FIG. 4 showing the relationship between the first raised sealing score 62 and the lower portion of the free edge 68 of side seam panel 58. FIG. 6 is an illustration, in section, of a portion of the container of FIG. 4 showing the relationship between the second raised sealing score 64 to the leading edge 78 of bottom panel 40. For illustrative purposes, the dimensions of the features in FIGS. 5 and 6 have been exaggerated. FIGS. 5 and 6 have been rotated approximately 180° to show the assembled container with the bottom surface thereof towards the bottom of the illustration.

Leakage due to edge seepage is well known to be caused by an imperfect seal at the glued edge of the side seam and bottom panel. Leakage is enhanced by the effects of the surface tension relationship between the liquid and the panel surface such that the liquid is essentially drawn out beyond the seal. For bottom seals, the problem is further compounded by the static pressure of the fluid which acts in concert with the effects of surface tension.

In the past, efforts at minimizing edge seepage usually have focused on an improved adhesive to treat problem areas such as edge 68 of side seam panel 58 or edge 78 of bottom panel 40. Naturally, selective coating of these areas with different adhesives or other special localized treatments results in increased production costs. However, with a raised sealing score as provided by the present invention, the effects of surface tension are mitigated by the physical abutment between the raised sealing score and the edge of the panel.

The raised sealing score itself is formed when the blank is initially scored. No subsequent production steps are required, yielding a substantial savings in production cost per blank. The improved seal provided by the panel edge substantially abutting the raised sealing score marks a point of departure of the present invention over the prior art.

In FIG. 5 and 6, fluid (not shown) in the container seeks to travel along interface 80 between side seam panel 58 and bottom panel 38 (FIG. 5), as well as along interface 82 between bottom panels 38 and 40 (FIG. 6).

However, by fabricating the container blank so that free edge 68 abuts the raised portion of first raised sealing score 62 (FIG. 5), the surface tension of the fluid cannot cause seepage along the interface beyond raised sealing score 62. Leakage from container edge seepage is therefore eliminated. Leakage is similarly eliminated along interface 82 (FIG. 6), since free edge 78 abuts the raised portion of raised sealing score 64.

In the preferred embodiment, the raised portions of the first and second sealing scores should substantially abut free edges 68 and 78 and extend generally therealong. The sealing scores themselves are otherwise conventional, and typically have the same parameters and, as noted above, are formed in the same manner as the other score lines formed in the blank described with respect to FIG. 1.

Similarly, although the invention has been shown and described with respect to a preferred embodiment thereof, it should be understood by those skilled in the art that various other changes, omissions and additions thereto may be made therein without departing from the spirit and scope of the invention. Specifically, one or more sealing scores may be used in other than bottom portions of the liquid container where liquid seepage is a problem.

What is claimed is:

1. A method for sealing a liquid container formed from a blank having a plurality of cooperative panels foldable about a plurality of folding score lines, comprising the steps of:

forming a raised sealing score having a front and a rear edge in a first panel and assembling said blank into a container so that the free edge of a second panel having a longitudinal free edge substantially abuts the raised portion of said raised sealing score; said abutting free edge contacting the front edge of said raised sealing score; and heat sealing the liquid container without deforming said free edge whereby after sealing the effects of surface tension of a liquid contained in the sealed liquid container are mitigated by the physical abutment between said raised sealing score and said abutting free edge of said panel.

2. A method for sealing a liquid container as defined in claim 1 wherein a plurality of raised sealing scores are formed in a plurality of said cooperative panels, said raised sealing scores being adapted, upon assembly of the blank into a container, to substantially abut free edges of other cooperative panels and thereby prevent liquid seepage from said container.

* * * * *

UNITED STATES PATENT AND TRADEMARK OFFICE

CERTIFICATE OF CORRECTION

PATENT NO. : 5,021,040

DATED : June 4, 1991

INVENTOR(S) : Robert D. Phillips

It is certified that error appears in the above—identified patent and that said Letters Patent is hereby corrected as shown below:

On the title page, item [73] should read:

Assignee: Champion International Corporation,
Stamford, Connecticut

Signed and Sealed this

Nineteenth Day of January, 1993

*Attest:*

DOUGLAS B. COMER

*Attesting Officer*

*Acting Commissioner of Patents and Trademarks*